US011859860B2

(12) United States Patent
Churi Veerappa et al.

(10) Patent No.: US 11,859,860 B2
(45) Date of Patent: Jan. 2, 2024

(54) TUBE GUIDE FOR HVAC SYSTEM

(71) Applicant: Johnson Controls Technology Company, Auburn Hills, MI (US)

(72) Inventors: Satish Churi Veerappa, Gadag (IN); Akshay S. Baljekar, Pune (IN); Akshat Jain, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 225 days.

(21) Appl. No.: 17/326,134

(22) Filed: May 20, 2021

(65) Prior Publication Data

US 2021/0364190 A1 Nov. 25, 2021

(30) Foreign Application Priority Data

May 20, 2020 (IN) ..... 202011021277

(51) Int. Cl.
*F24F 13/32* (2006.01)
*F24F 1/26* (2011.01)

(52) U.S. Cl.
CPC ..... *F24F 13/32* (2013.01); *F24F 1/26* (2013.01)

(58) Field of Classification Search
CPC ..... F24F 13/32; F24F 1/26
See application file for complete search history.

(56) References Cited

U.S. PATENT DOCUMENTS

| | | | | |
|---|---|---|---|---|
| 2,905,218 | A | 9/1959 | Smith et al. | |
| 6,768,058 | B2 | 7/2004 | Pallapothu | |
| 6,930,244 | B1 * | 8/2005 | Nebel | B60R 16/0207 248/65 |
| 7,093,807 | B2 * | 8/2006 | Wylie | H02G 3/32 248/68.1 |
| 7,389,616 | B2 * | 6/2008 | Gilleran | F24F 13/222 52/220.8 |
| 7,500,644 | B2 * | 3/2009 | Naudet | H02G 3/32 248/65 |
| RE46,708 | E * | 2/2018 | Karamanos | F24F 13/30 |
| 10,429,106 | B2 * | 10/2019 | Christians | F28D 21/0017 |
| 11,112,142 | B2 * | 9/2021 | Bewley, Jr. | F24F 13/20 |
| 11,506,434 | B2 * | 11/2022 | Mislak | F25B 39/00 |
| 2011/0056664 | A1 * | 3/2011 | De Larminat | F28D 3/04 165/160 |

FOREIGN PATENT DOCUMENTS

| | | | |
|---|---|---|---|
| CN | 104358281 | A1 | 2/2015 |
| GB | 1170557 | A | 11/1969 |
| GB | 2440008 | A | 1/2008 |

* cited by examiner

*Primary Examiner* — Anita M King
(74) *Attorney, Agent, or Firm* — Fletcher Yoder, P.C.

(57) ABSTRACT

A tube guide for a heating, ventilation, and/or air conditioning (HVAC) system includes a main body formed from a pliable material, a first slit formed through the main body, and a second slit formed through the main body and traversing the first slit to define a tube support location configured to receive a range of tube sizes.

19 Claims, 9 Drawing Sheets

TUBE GUIDE FOR HVAC SYSTEM

CROSS REFERENCE TO RELATED APPLICATIONS

This application claims priority from and the benefit of India Provisional Application Serial No. 202011021277, entitled "GROMMET FOR HVAC SYSTEM," filed May 20, 2020, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. The HVAC system may include tubes (e.g., conduits, piping) that may facilitate operation of the HVAC system. For example, tubes may be incorporated in the HVAC system to direct or circulate a fluid through the HVAC system. However, it may be difficult to support the tubes, such as tubes having different sizes, geometries, configurations, arrangements, and so forth, within the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a tube guide for a heating, ventilation, and/or air conditioning (HVAC) system includes a main body formed from a pliable material, a first slit formed through the main body, and a second slit formed through the main body and traversing the first slit to define a tube support location configured to receive a range of tube sizes.

In one embodiment, a tube guide for a heating, ventilation, and/or air conditioning (HVAC) system includes a main body formed from a pliable material and having a plurality of tube support locations and a plurality of slits formed through the main body. Each slit of the plurality of slits is crosswise to a corresponding slit of the plurality of slits to define a corresponding tube support location of the plurality of tube support locations, and each tube support location of the plurality of tube support locations is configured to receive a tube of the HVAC system.

In one embodiment, a heating, ventilation, and/or air conditioning (HVAC) system includes a plurality of tubes and a tube guide having a main body formed from a pliable material and a plurality of tube support locations of the main body. Each tube support location of the plurality of tube support locations is defined via a first slit formed through the main body and a second slit formed through the main body and traversing the first slit, and the tube guide is configured to support each tube of the plurality of tubes at a corresponding tube support location of the plurality of tube support locations.

DRAWINGS

Various aspects of this disclosure may be better understood upon reading the following detailed description and upon reference to the drawings in which.

DETAILED DESCRIPTION

Figure 1:
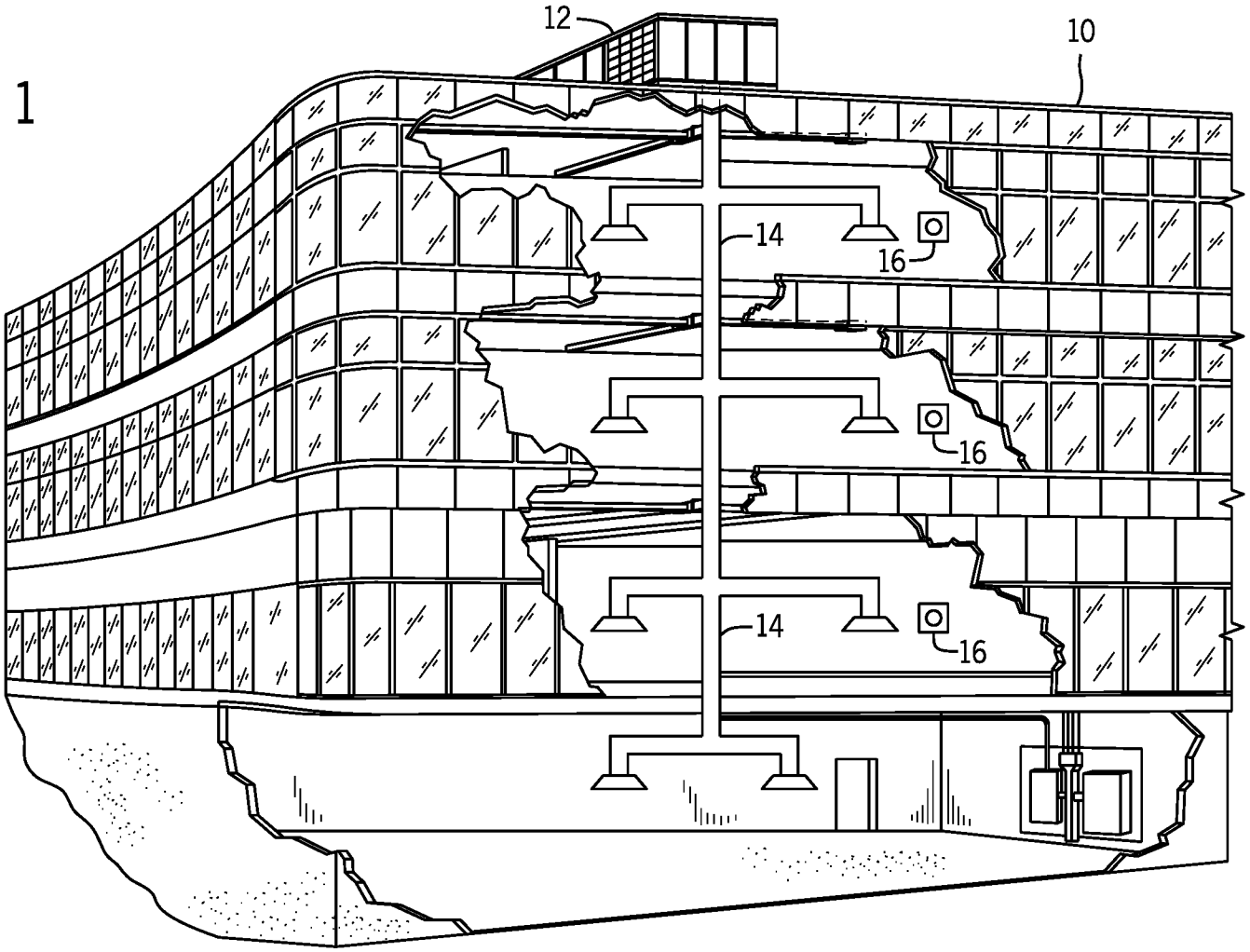
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. A refrigerant may be circulated through or across the HVAC system to condition an air flow, and the HVAC system may deliver the conditioned air flow to a space serviced by the HVAC system. Thus, the HVAC system may condition the space, such as to adjust a temperature and/or a humidity of the space. The HVAC system may include various tubes, such as pipes, conduits, hoses, and/or electrical harnesses, that extend throughout the HVAC system. For instance, the tubes may facilitate operation of the HVAC system by directing the refrigerant to different components of the HVAC system.

It may be desirable to guide or support each of the tubes of the HVAC system, for example, to maintain an arrangement or orientation of the tubes and/or to restrict movement of the tubes within the HVAC system. However, different HVAC systems may include different embodiments, configurations, arrangements, and/or types of tubes. For example, different HVAC systems may have tubes with different sizes, tubes having different shapes (e.g., cross-sectional geometries), tubes located at different positions, and the like. In conventional approaches, a particular or specific guide (e.g., a guide have a particularly sized opening) may be manufactured to accommodate and support the specific tubes incorporated in the HVAC system. Thus, multiple embodiments of guides may be manufactured to accommodate the various arrangements of tubes for different HVAC systems. That is, each HVAC system may have a different embodiment of a guide that is particularly manufactured and incorporated based on the specific arrangement of tubes of the HVAC system. However, manufacture and/or installation of different embodiments of guides may increase a cost and/or complexity associated with production of the HVAC system.

Thus, it is presently recognized that a guide configured to accommodate and support different embodiments of tubes (e.g., tubes having different sizes) may improve production of HVAC systems. Accordingly, embodiments of the present disclosure are directed to a tube guide that can receive, accommodate, and support various arrangements of tubes. The tube guide may include a main body coupled to a carrier plate. The main body may include a set of tube support locations, and a tube may be inserted through one of the tube support locations. Each tube support location may be configured to receive different embodiments of tubes, such as a range of tube sizes and/or shapes. By way of example, the main body may be formed from a pliable or flexible material that can deform and adjust to receive, accommodate, and support a particular tube. The main body may also restrict movement of the tubes within the tube support locations. For example, when a tube is positioned within a tube support location, the main body may be biased against the tube extending within the tube support location to support and/or retain the tube within the tube support location. The carrier plate may facilitate mounting of the tube guide to another component of the HVAC system, thereby restricting movement between the main body of the tube guide and the HVAC system and/or fixing a location of the tube guide within the HVAC system. In this way, the tube guide may function as a support for different types, configurations, and/or arrangements of tubes extending through the tube guide. Accordingly, a single embodiment of the tube guide may be manufactured to support multiple different tube arrangements for different HVAC systems, thereby reducing a cost and/or complexity associated with production of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
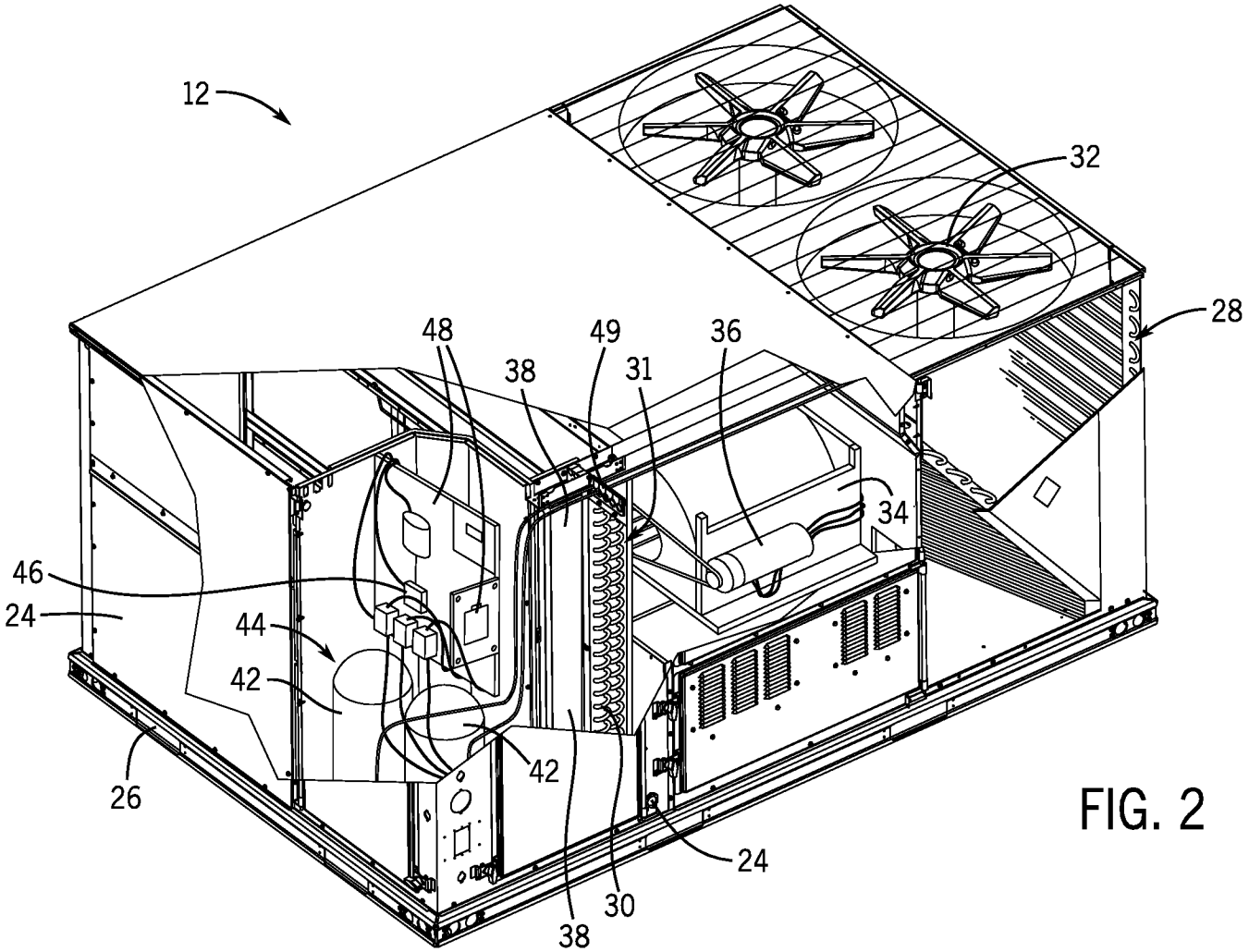
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
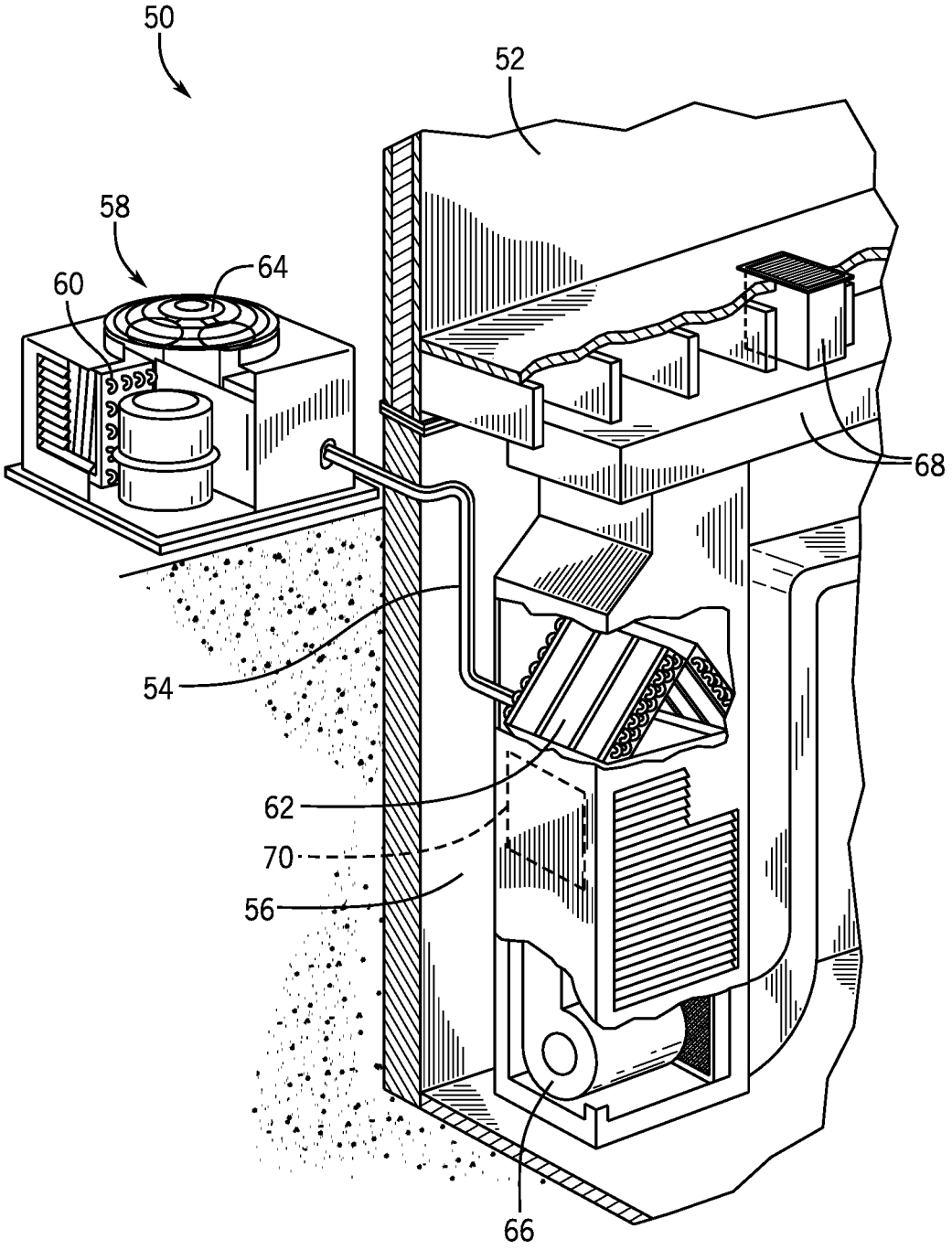
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
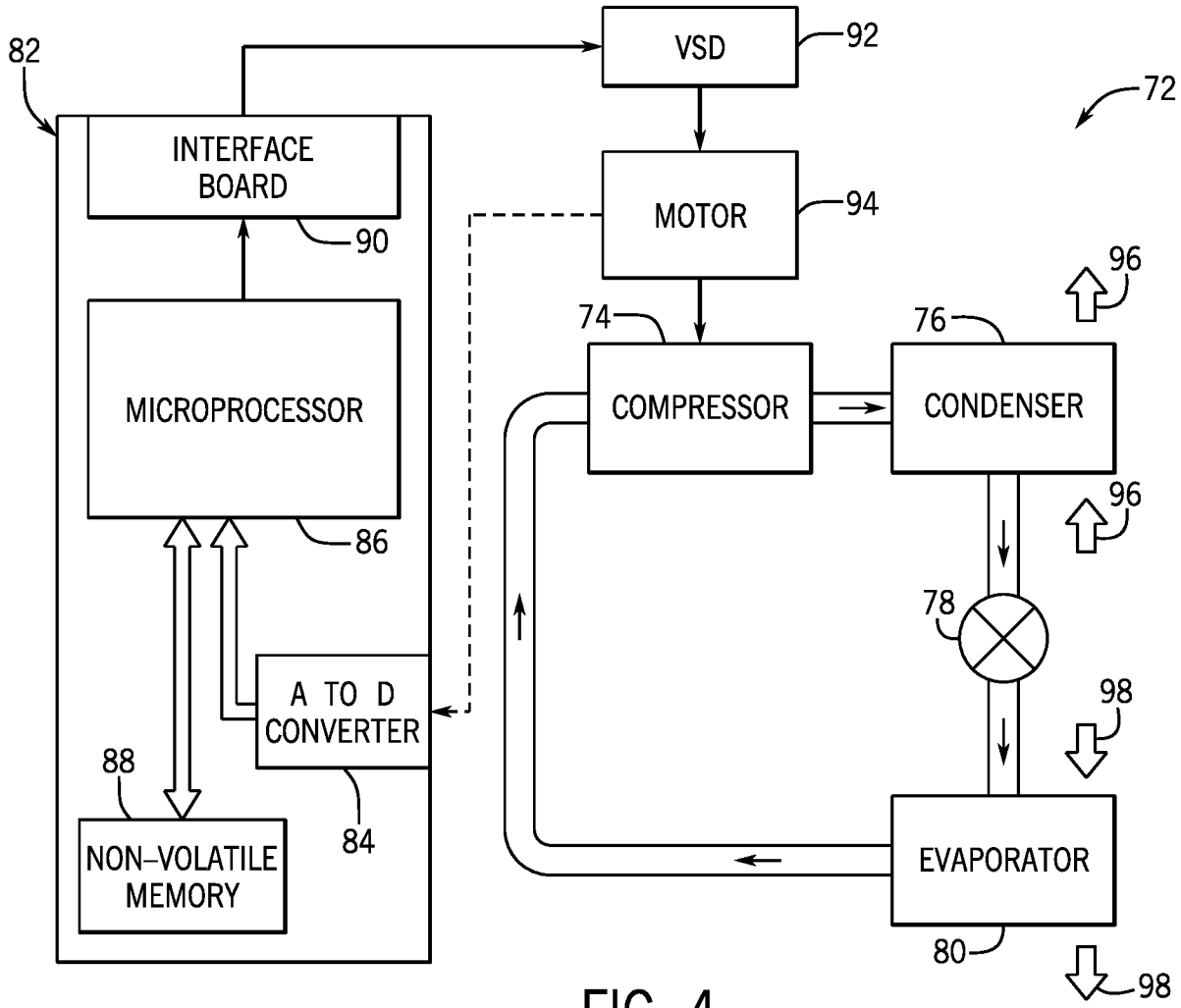
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to an HVAC system having various tubes (e.g., conduits) that extend throughout the HVAC system. In certain HVAC systems, the tubes may have different sizes, such as different diameters, arrangements, configurations, geometries, or other varying features. A tube guide of the HVAC system may be configured to support the tubes of different sizes. For example, the tube guide may include a main body that may have openings, slits, notches, grooves, or cuts that define tube support locations configured to accommodate the tubes. For instance, the main body may be pliable, flexible, or adjustable to enable insertion or extension of the tubes through the main body via the tube support locations. Thus, a single embodiment of the tube guide can support different arrangements or embodiments of tubes, such as for different HVAC systems. Further, while the present disclosure describes the tube guide in the context of use with tubes of the HVAC system, it should be noted that the present embodiments may be utilized to support conduits of any type, shape, geometry, or configuration. Indeed, tubes and/or conduits configured to route fluids, power, control signals, sensor feedback, cables, or any other type of tube or conduit may be utilized with the disclosed tube guides.

Figure 5:
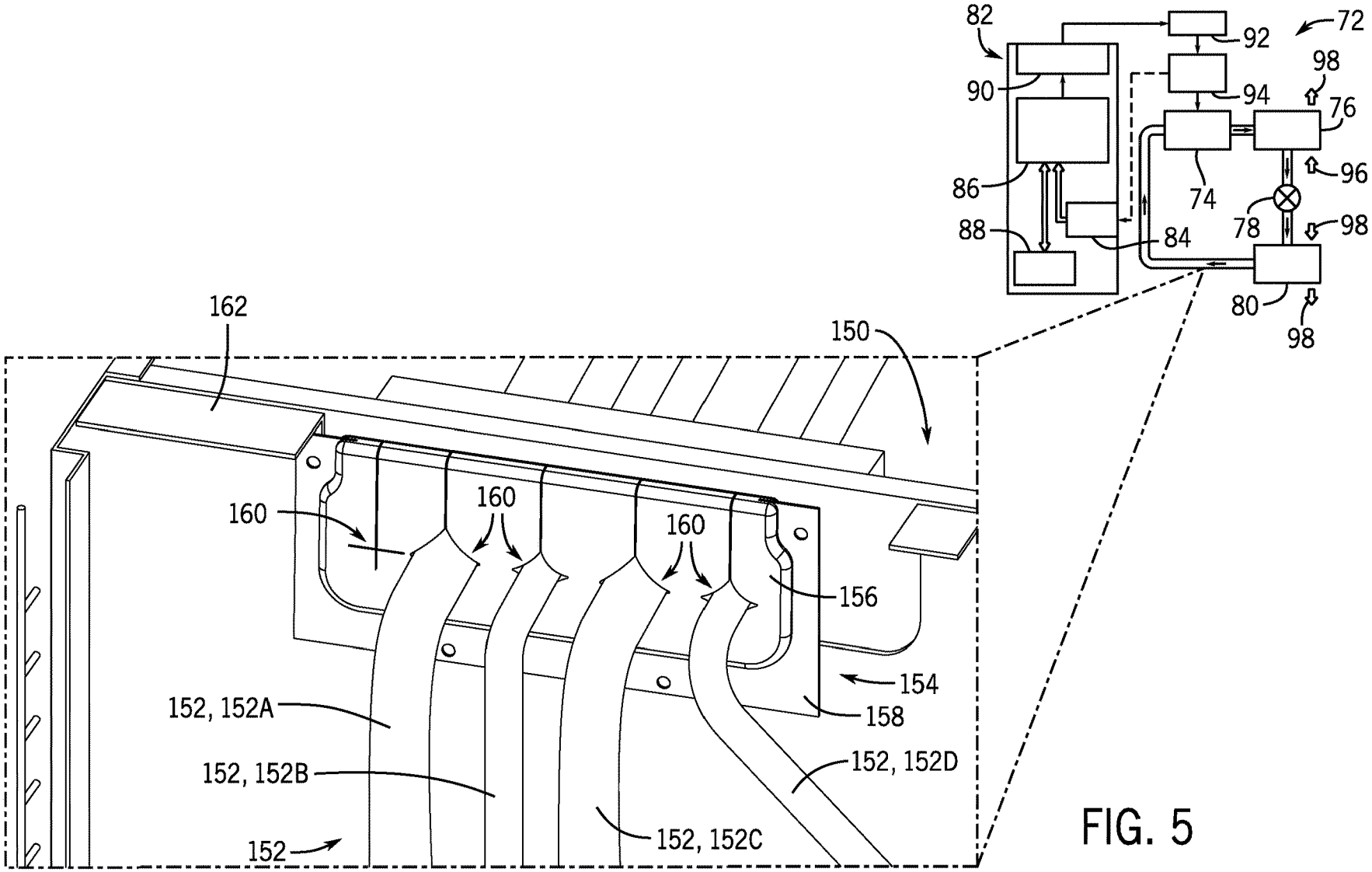
FIG. 5 is a perspective view of an embodiment of an HVAC system having a tube guide, in accordance with an aspect of the present disclosure.

With this in mind, FIG. 5 is a perspective view of an embodiment of an HVAC system 150 with multiple tubes 152, such as pipes, conduits, hoses, electrical harnesses, and other components extending within the HVAC system 150. As an example, a fluid, such as a refrigerant, may be directed through one or more of the tubes 152. The tubes 152 of the illustrated HVAC system 150 include a first tube 152A, which may have a first size, dimension, shape, and/or geometry (e.g., a first diameter), a second tube 152B, which may have a second size, dimension, shape, and/or geometry (e.g., a second diameter), a third tube 152C, which may have a third size, dimension, shape, and/or geometry (e.g., a third diameter), and a fourth tube 152D, which may have a fourth size, dimension, shape, and/or geometry (e.g., a fourth diameter). For example, the size (e.g., diameter) of each of the tubes 152 may be different from one another in some embodiments. Further, additional or alternative HVAC systems 150 may include a different number of tubes 152 and/or tubes 152 having different sizes, dimensions, shapes, and/or geometries than the illustrated HVAC system 150. In other words, different HVAC systems 150 may have different configurations and/or arrangements of the tubes 152.

The HVAC system 150 may also include a tube guide 154 through which the tubes 152 may extend. The tube guide 154 may support the tubes 152, such as by restricting movement of the tubes 152 relative to one another and/or relative to other components of the HVAC system 150 (e.g., structural components, components to which the tubes 152 are connected, etc.). In some embodiments, the tube guide 154 may include a main body 156 coupled to a carrier plate 158. The tubes 152 may be inserted through the main body 156. For instance, the main body 156 may include various tube support locations 160, each of which is configured to receive one or more of the tubes 152. Each of the tube support locations 160 may restrict movement of a corresponding tube 152 relative to the main body 156. Additionally, the carrier plate 158 may be coupled (e.g., via fasteners, adhesives, welds) to a component of the HVAC system 150, such as to a panel 162 disposed within the HVAC system 150. With the carrier plate 158 coupled (e.g., mounted) to the panel 162 and the tubes 152 disposed within the tube support locations 160, the carrier plate 158 may restrict movement of the main body 156, and therefore of the tubes 152, within the HVAC system 150.

Figure 6:
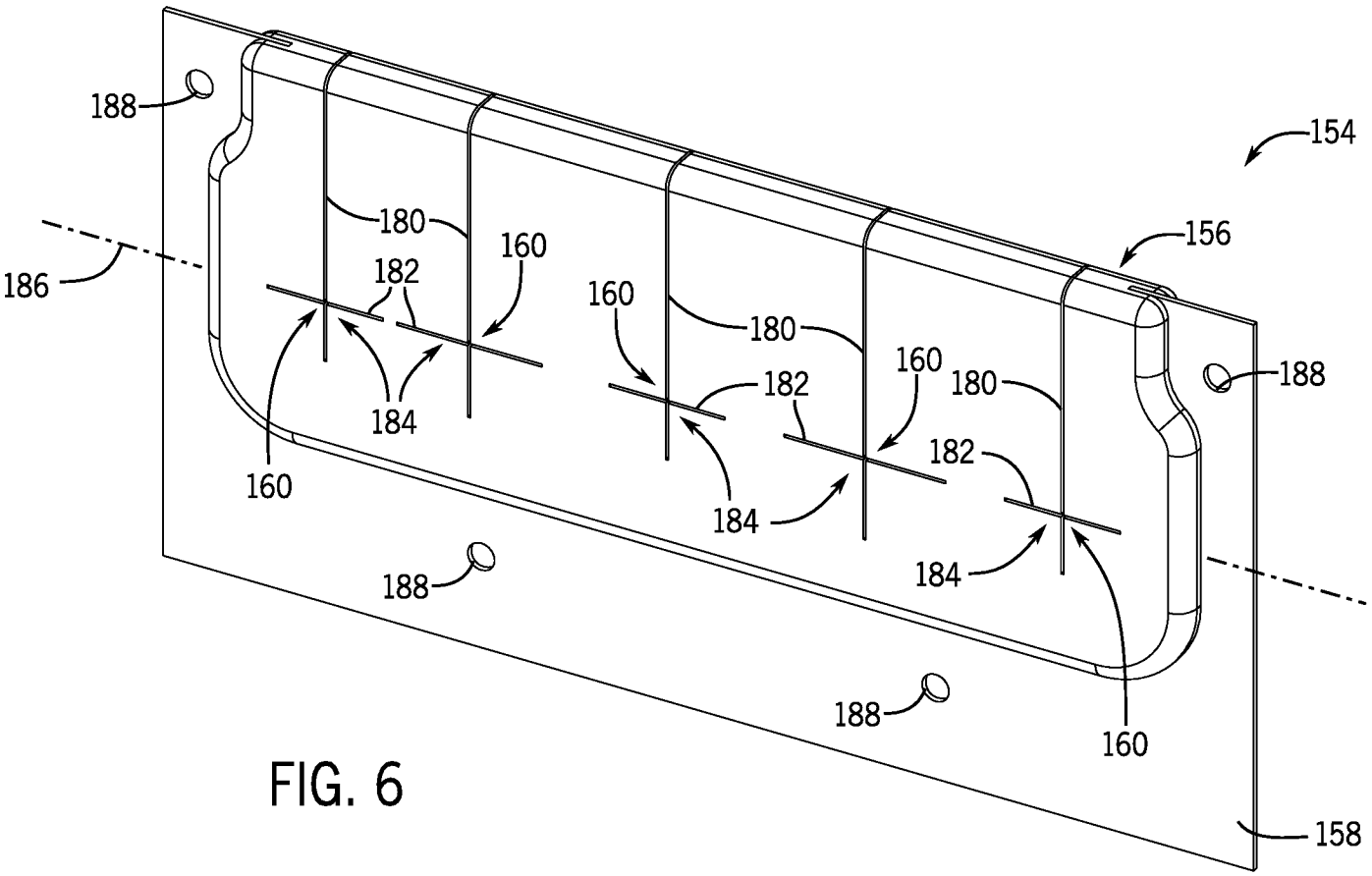
FIG. 6 is a perspective view of an embodiment of a tube guide that may be incorporated in an HVAC system, in accordance with an aspect of the present disclosure.

FIG. 6 is a perspective view of an embodiment of the tube guide 154. The main body 156 of the illustrated tube guide 154 includes five tube support locations 160, but an additional or alternative embodiment of the tube guide 154 may include a main body 156 having any suitable number (e.g., one, two, three, four, more than five) of tube support locations 160. Further, in the illustrated embodiment, each tube support location 160 is defined via a respective first slit (e.g., a cut, a groove, a notch, a slot, etc.) 180 and a respective second slit 182 formed through the main body 156. The first slit 180 and the second slit 182 traverse one another to forma set of flaps 184 (e.g., four flaps) for each tube support location 160. Although the illustrated first slit 180 and second slit 182 are oriented generally perpendicularly (e.g., within 3 degrees) to one another, an additional or alternative embodiment of the first slit 180 and the second slit 182 may be oriented crosswise to one another in any suitable manner. In further embodiments, there may be any suitable number of slits formed through the main body 156 to form any corresponding number of flaps 184 for each tube support location 160. Further still, it should be noted that the slits 180, 182 may have different sizes (e.g., different lengths, different widths) relative to one another such that the tube support locations 160 may have different sizes. As an example, the slits 180, 182 for one of the plurality of tube support locations 160 may have an increased size to accommodate a first range of tubes (e.g., tubes having an increased size, tubes of a first geometry), and the slits 180, 182 for another of the plurality of tube support locations 160 may have a reduced size to accommodate a second range of tubes (e.g., tubes having a reduced size, tubes of a second geometry).

The main body 156 may be formed from a pliable, flexible, or adjustable material, such as rubber, polymer, and/or foam, to enable the flaps 184 to deform and accommodate insertion of one of the tubes 152 within the tube support location 160 associated with the tube 152. Indeed, the pliability of the set of flaps 184 may enable the tube support location 160 to receive and accommodate a range of tube sizes, configurations, geometries, arrangements, and/or shapes. Additionally, the flaps 184 of the tube support location 160 may bias against the tube 152 received at the tube support location 160 to secure the tube 152 within the tube support location 160. For example, the tube 152 may be inserted into the tube support location 160 by translating the tube 152 along the first slit 180 and/or by inserting and extending the tube 152 through the flaps 184. Such insertion of the tube 152 may impart a force on the flaps 184 that causes elastic deformation of the flaps 184 to enable placement of the tube 152 within the tube support location 160. Removal of the force after the tube 152 is positioned within the tube support location 160 may cause the flaps 184 to restore and move toward an undeformed arrangement and bias against the tube 152, thereby securing the tube 152 within the tube support location 160. Indeed, the material of the main body 156 may form flaps 184 having sufficient flexibility to enable insertion of the tubes 152 into the tube support locations 160 and appropriate resilience to retain the tubes 152 within the tube support locations 160.

In some embodiments, each of the tube support locations 160 may be formed and/or positioned (e.g., arrayed) along an axis 186 that extends along a first length 187 of the tube guide 154. To this end, each of the second slits 182 may be collinear and offset along the axis 186. In certain embodiments, a distance or spacing between adjacent tube support locations 160 along the axis 186 may be different. In additional or alternative embodiments, the distance or spacing between adjacent tube support locations 160 along the axis 186 may be the same. In further embodiments, the tube support locations 160 may not be located along the same axis 186 (e.g., the second slits 182 may not be collinear along the axis 186, the second slits 182 may be offset from one another along a second length 189 of the tube guide 154). Thus, the tube support locations 160 may be offset relative to one another in any manner relative to the lengths 187, 189 of the tube support guide 154. Indeed, the slits 180, 182 may be formed in any suitable arrangement to create the tube support locations 160 and the flaps 184 in the main body 156 as desired (e.g., based on an expected number of tubes 152, arrangement of tubes 152, geometry of tubes 152, etc.).

The main body 156 may be coupled (e.g., fixedly attached) to the carrier plate 158, and the carrier plate 158 may be coupled (e.g., fixedly attached, mounted) to another component of the HVAC system 150 to support the tubes 152 in an installed configuration of the tube guide 154. By way of example, the carrier plate 158 may include a first set of holes or openings 188. The first set of holes 188 may align with corresponding holes or openings of the component of the HVAC system 150 (e.g., panel 162), and a fastener may be inserted through the aligned holes to couple the carrier plate 158 to the component. In additional or alternative embodiments, the carrier plate 158 may be coupled to the component in a different manner, such as via an adhesive, a weld, a punch, a hook, and so forth. Moreover, the carrier plate 158 may be formed from a rigid material, such as a metal, a carbon fiber, and the like, to facilitate securement of the carrier plate 158 and restrict movement of the carrier plate 158 and therefore the main body 156 within the HVAC system 150.

Figure 7:
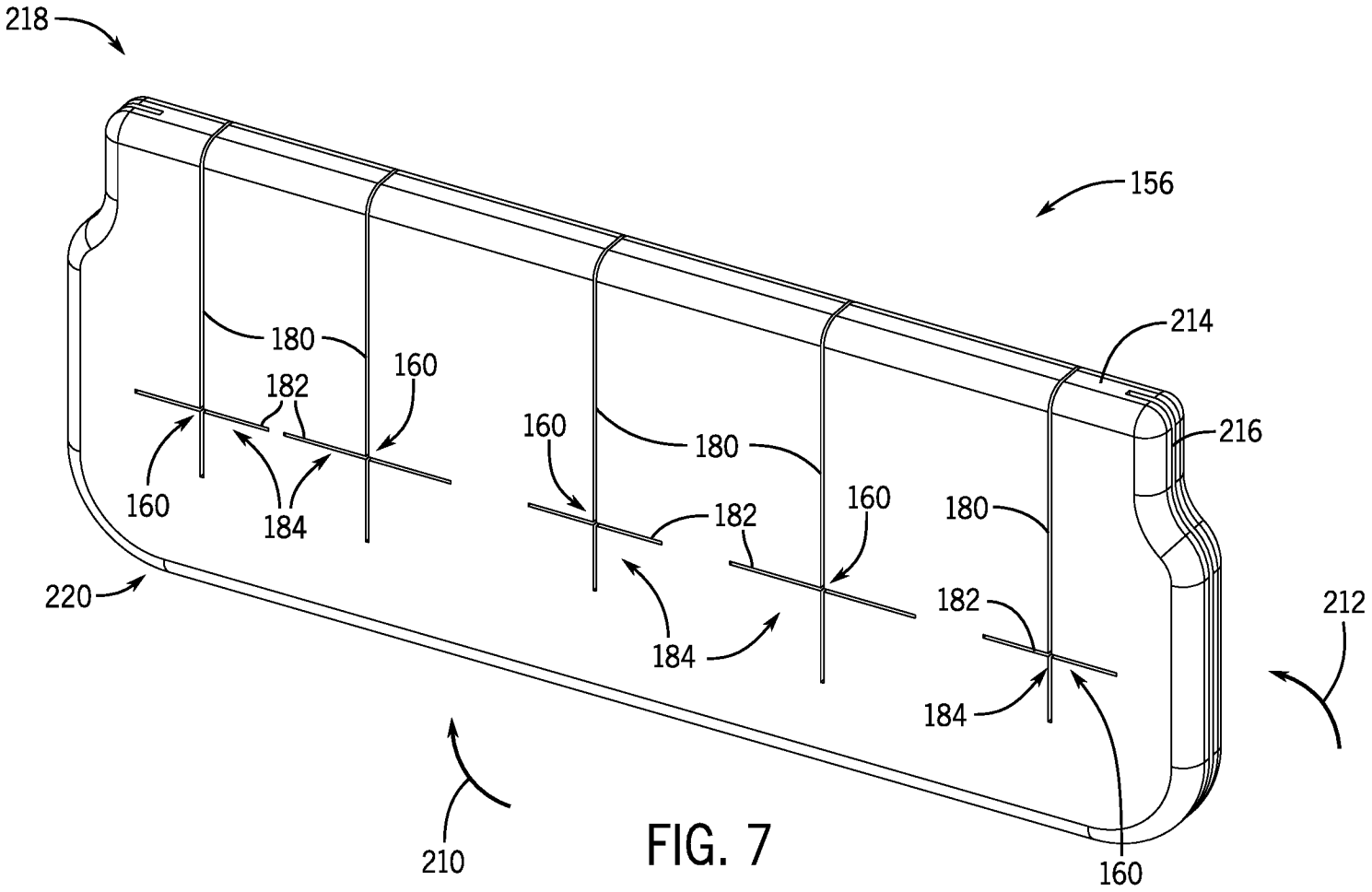
FIG. 7 is a perspective view of an embodiment of a main body of a tube guide, in accordance with an aspect of the present disclosure.

FIG. 7 is a perspective view of an embodiment of the main body 156. The illustrated main body 156 includes a first portion 210 and a second portion 212 that are coupled to one another via an intermediate portion 214. The intermediate portion 214 may offset the first portion 210 and the second portion 212 from one another to form a gap 216 between the first portion 210 and the second portion 212. The carrier plate 158 may be positioned within the gap 216 such that the first portion 210 and the second portion 212 capture the carrier plate 158 therebetween. In this arrangement, the first portion 210 is disposed on a first side of the carrier plate 158, and the second portion 212 is disposed on a second side, opposite the first side, of the carrier plate 158. Additionally, referring back to FIG. 6, ends 215 of the intermediate portion 214 may abut and/or be biased against (e.g., via force of gravity) an edge 217 of the carrier plate 158 in the installed configuration of the tube guide 154. In this way, the main body 156 may be secured to and supported by the carrier plate 158.

Continuing with reference to FIG. 7, each of the first portion 210 and the second portion 212 may include respective first slits 180 and second slits 182. The first slits 180 of the first portion 210 may align with corresponding first slits 180 of the second portion 212, and the second slits 182 of the first portion 210 may align with corresponding second slits 182 of the second portion 212. Thus, each tube support location 160 may include aligned first slits 180 of the first portion 210 and first slits 180 of the second portion 212, as well as aligned second slits 182 of the first portion 210 and second slits 182 of the second portion 212.

Furthermore, in the illustrated embodiment, a first edge 218 of the main body 156 (e.g., the edge along which the intermediate portion 214 extends, an upper edge, first side) may have a first length that is less than a second length of a second edge 220 (e.g., lower edge, second side) of the main body 156. The illustrated geometry of the main body 156 may facilitate exposure of each of the first set of holes 188 of the carrier plate 158 when the main body 156 and the carrier plate 158 are coupled to one another in an assembled configuration of the tube guide 154. That is, the reduced length of the first edge 218 (e.g., the contoured geometry of the main body 156 at the first edge 218) may expose the first set of holes 188 positioned proximate to the intermediate portion 214 in the assembled configuration. Thus, the carrier plate 158 may be manufactured without an increased length and/or the main body 156 may be manufactured without a reduced overall length, while also facilitating coupling of the carrier plate 158 to the HVAC system 150 via the first set of holes 188. The reduced or limited length of the carrier plate 158 may reduce manufacturing costs and/or a footprint of the tube guide 154 in the installed configuration, and the increased overall length or width of the main body 156 may provide additional support for the tubes 152 and/or provide an increased number of tube support locations 160. Further still, the illustrated tube guide 154 includes fillets 222 extending along at least a portion of the perimeter of the tube guide 154 (e.g., along the first edge 218, the second edge 220). The fillets 222 may facilitate handling of the main body 156 (e.g., to couple to the carrier plate 158).

Figure 8:
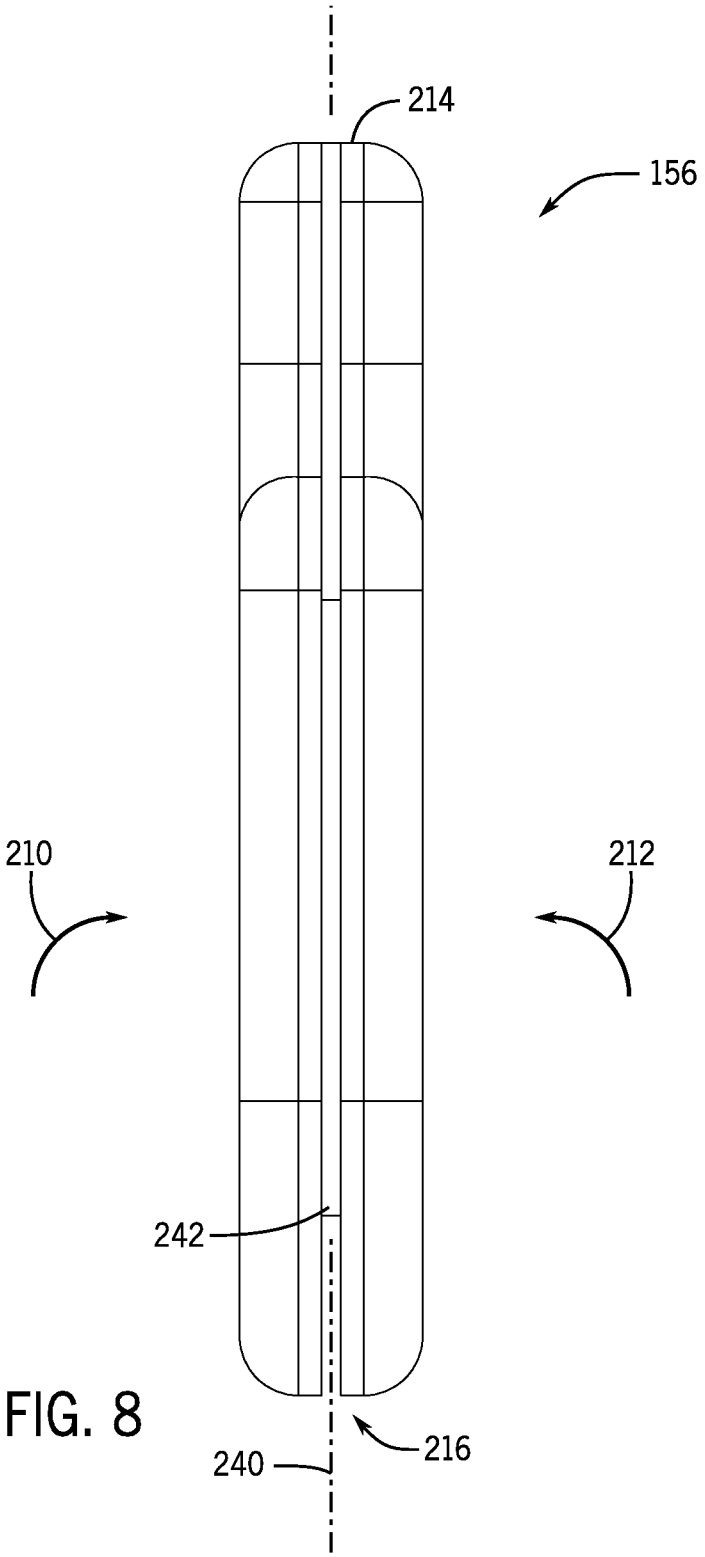
FIG. 8 is a side view of an embodiment of a main body of a tube guide, in accordance with an aspect of the present disclosure.

FIG. 8 is a side view of an embodiment of the main body 156. In the illustrated embodiment, the first portion 210 and the second portion 212 are generally symmetrical about an axis 240 (e.g., central axis) extending (e.g., extending vertically) through the main body 156. However, in additional or alternative embodiments, the first portion 210 and the second portion 212 may be asymmetrical about the axis 240. Additionally, the illustrated main body 156 includes a section 242 (e.g., connecting segment) extending between the first portion 210 and the second portion 212 (e.g., through the gap 216) from the intermediate portion 214 toward the second edge 220. The section 242 may facilitate coupling between the main body 156 and the carrier plate 158. For example, in the assembled configuration, the section 242 may abut against an edge of the carrier plate 158 to facilitate positioning of the main body 156 relative to the carrier plate 158 during assembly of the tube guide 154. Indeed, the section 242 may block the carrier plate 158 from further extending into the gap 216 to an undesirable position of the main body 156 relative to the carrier plate 158, such as a position that would cause the carrier plate 158 to overlap with the tube support locations 160 and block insertion of the tubes 152 through the tube support locations 160. Thus, the section 242 may extend past the slits 180, 182 to block overlap between the carrier plate 158 and the tube support locations 160 in the installed configuration of the tube guide 154, and the slits 180, 182 may be formed through the section 242 to enable insertion of the tubes 152 through the main body 156. In certain embodiments, the section 242 may extend from a part (e.g., a center) of the intermediate portion 214. However, a remainder of the intermediate portion 214 (e.g., the ends 215) may not be connected to the intermediate portion 214. Thus, such part of the intermediate portion 214 may be configured to abut against the edge 217 of the carrier plate 158. In some embodiments, the main body 156 may be further secured to the carrier plate 158, such as via fasteners, upon desirable positioning of the main body 156 relative to the carrier plate 158 via abutment between the section 242 and the carrier plate 158.

Figure 9:
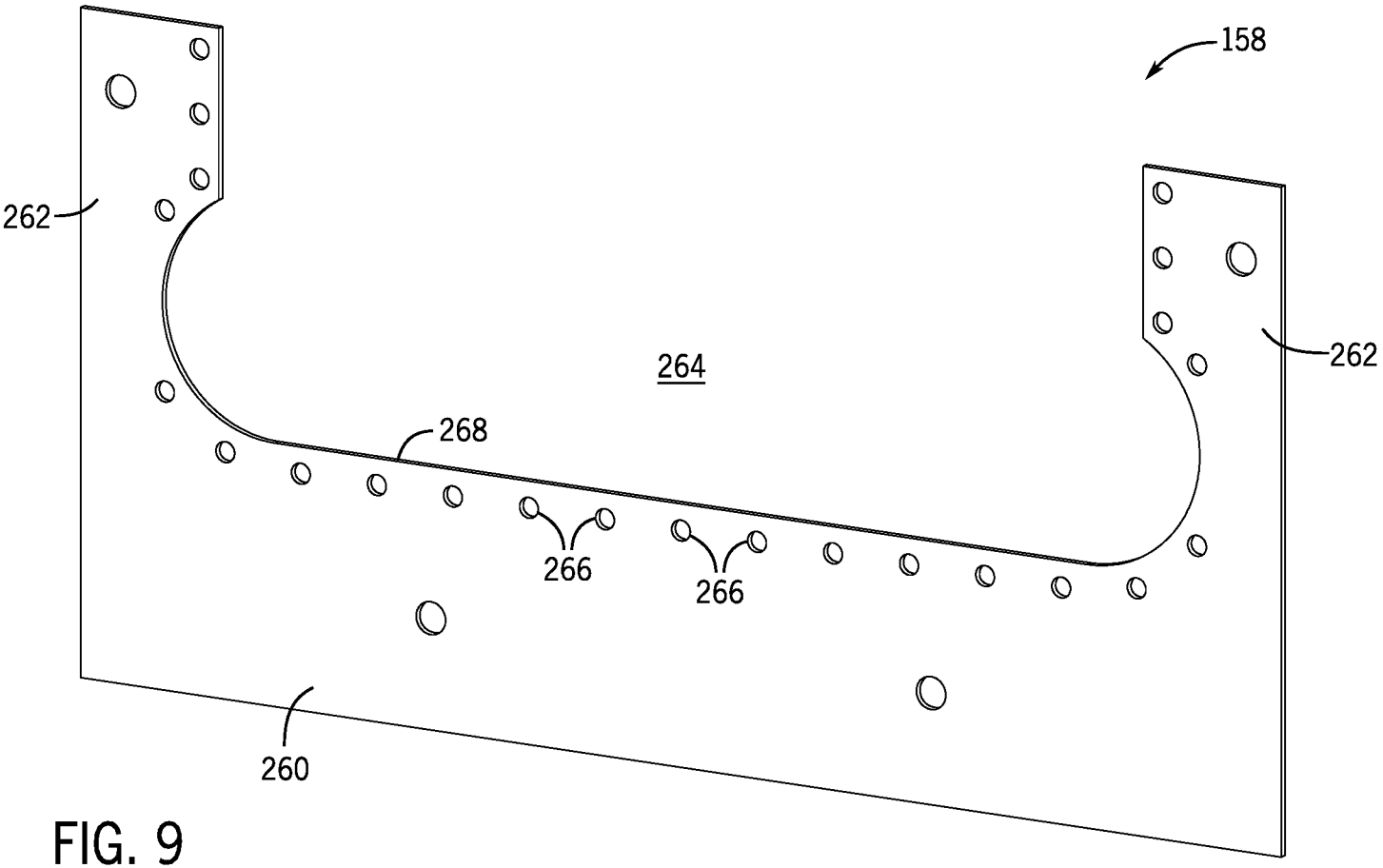
FIG. 9 is a perspective view of an embodiment of a carrier plate of a tube guide, in accordance with an aspect of the present disclosure.

FIG. 9 is a perspective view of an embodiment of the carrier plate 158. The illustrated carrier plate 158 has a U-shaped geometry with a base portion 260 and arms 262 (e.g., extensions, support arms) extending from the base portion 260. Thus, the carrier plate 158 forms a recess 264 that may receive and/or accommodate at least a portion of the main body 156. In the installed configuration of the tube guide 154, the arms 262 may at least partially support the main body 156, and the tube support locations 160 of the main body 156 and the recess 264 may overlap with one another to enable insertion of the tubes 152 through the tube support locations 160. In the illustrated embodiment, each of the arms 262 extends from the base portion 260 in a generally common direction. Additionally, each arm 262 includes a curved inner surface 263 (e.g., first inner surface) extending from the base portion 260 and a straight inner surface 265 (e.g., second inner surface) extending from the curved inner surface 263. The curved inner surface 263 and straight inner surface 265 of each arm 262 at least partially define the recess 264 and generally form a hook shape of the respective arm 262. The curved inner surface 263 of each arm 262 may increase a size (e.g., cross-sectional are) of the recess 264, which may enable an increase in the number of tube support locations 160 included in the main body 156 and/or the number, configuration, arrangement, size, and or geometry of tubes 152 accommodated by the tube guide 154. However, each of the arms 262 may extend from the base portion 260 in any suitable manner and have any other suitable configuration or geometry in additional or alternative embodiments.

The carrier plate 158 may also include a second set of holes 266 formed in the base portion 260 and/or the arms 262 along an edge 268 of the base portion 260 adjacent to (e.g., at least partially defining) the recess 264. The second set of holes 266 may facilitate coupling of the main body 156 and the carrier plate 158 to one another. As an example, the main body 156 may have corresponding holes formed therein and configured to align with the second set of holes 266 when the main body 156 is positioned within the recess 264 (e.g., to abut the section 242 against the edge 268 the carrier plate 158), and a fastener may be inserted through the aligned holes to secure the main body 156 and the carrier plate 158 to one another.

The present disclosure may provide one or more technical effects useful in the operation of an HVAC system. For example, the HVAC system may have tubing and a tube guide that supports a position and/or arrangement of the tubing within the HVAC system. The tube guide may have a main body that includes multiple tube support locations. Each of the tube support locations may be configured to receive a range of tube sizes and/or shapes. As an example, slits may be formed through the main body to define the tube support locations, and the main body may be formed from a pliable material to enable the main body to deform and receive differently sized tubes via the tube support locations. Furthermore, the main body may be coupled to a carrier plate of the tube guide. The carrier plate may fixedly couple to another component of the HVAC system, thereby restricting movement of the main body and the tubing relative to the HVAC system to support the tubing. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A tube guide for a heating, ventilation, and/or air conditioning (HVAC) system, comprising:

a main body formed from a pliable material and comprising a first portion and a second portion, wherein the first portion is offset from the second portion to form a gap therebetween, and wherein the gap is configured to receive a carrier plate of the HVAC system;

a first slit formed through the main body; and a second slit formed through the main body and traversing the first slit to define a tube support location configured to receive a range of tube sizes.

2. The tube guide of claim 1, wherein the first slit and the second slit define a plurality of flaps of the main body, and each flap of the plurality of flaps is configured to bias against a tube received by the tube support location.

3. The tube guide of claim 1, wherein the tube support location is a first tube support location, the first portion comprises the first slit and the second slit, the second portion comprises a third slit and a fourth slit traversing the third slit to define a second tube support location, and the second tube support location is aligned with the first tube support location.

4. The tube guide of claim 3, wherein the first portion is configured to be disposed on a first side of the carrier plate, and the second portion is configured to be disposed on a second side of the carrier plate.

5. The tube guide of claim 1, wherein the first slit is generally perpendicular to the second slit.

6. The tube guide of claim 1, wherein the pliable material comprises rubber, polymer, foam, or any combination thereof.

7. The tube guide of claim 1, comprising:

a third slit formed through the main body; and a fourth slit formed through the main body and traversing the third slit to define an additional tube support location configured to receive an additional range of tube sizes.

8. The tube guide of claim 7, wherein the second slit and the fourth slit extend along a common axis.

9. The tube guide of claim 7, wherein each of the first slit, the second slit, the third slit, and the fourth slit comprises a different length.

10. A tube guide for a heating, ventilation, and/or air conditioning (HVAC) system, comprising:

a main body formed from a pliable material and having a plurality of tube support locations;

a plurality of slits formed through the main body, wherein each slit of the plurality of slits is crosswise to a corresponding slit of the plurality of slits to define a corresponding tube support location of the plurality of tube support locations, wherein each tube support location of the plurality of tube support locations is configured to receive a tube of the HVAC system; and a carrier plate configured to couple to the HVAC system in an installed configuration of the tube guide and to support the main body in the installed configuration.

11. The tube guide of claim 10, wherein the carrier plate comprises a base portion and arms extending from the base portion to define a recess, the arms are configured to at least partially support the main body, and the plurality of tube support locations and the recess overlap with one another in the installed configuration of the tube guide.

12. The tube guide of claim 10, wherein the carrier plate comprises a set of holes formed therein and configured to receive fasteners to mount the carrier plate to a panel of the HVAC system.

13. The tube guide of claim 10, wherein the carrier plate is formed from a rigid material.

14. The tube guide of claim 13, wherein the rigid material is metal, and the pliable material is rubber.

15. The tube guide of claim 10, wherein each slit of the plurality of slits is generally perpendicular to the corresponding slit of the plurality of slits to define the corresponding tube support location of the plurality of tube support locations, and wherein each tube support location of the plurality of tube support locations is arrayed along a common axis.

16. A heating, ventilation, and/or air conditioning (HVAC) system, comprising:

a plurality of tubes;

a tube guide comprising a main body formed from a pliable material and a plurality of tube support locations of the main body, wherein each tube support location of the plurality of tube support locations is defined via a first slit formed through the main body and a second slit formed through the main body and traversing the first slit, wherein the tube guide is configured to support each tube of the plurality of tubes at a corresponding tube support location of the plurality of tube support locations; and a carrier plate configured to support the main body in an installed configuration of the tube guide, wherein the carrier plate is configured to be fixedly coupled to the HVAC system in the installed configuration of the tube guide.

17. The HVAC system of claim 16, wherein the main body comprises a first portion, the plurality of tube support locations is a first plurality of tube support locations formed through the first portion of the main body, the main body comprises a second portion and a second plurality of tube support locations formed through the second portion of the main body, each tube support location of the second plurality of tube support locations is defined via a third slit formed through the second portion and a fourth slit formed through the second portion and traversing the third slit, and each tube support location of the second plurality of tube support locations is aligned with a corresponding tube support location of the first plurality of tube support locations.

18. The HVAC system of claim 17, wherein the main body comprises an intermediate portion coupled to and offsetting the first portion and the second portion from one another to form a gap between the first portion and the second portion, wherein the carrier plate is configured to extend into the gap between the first portion and the second portion and abut the intermediate portion to support the main body in the installed configuration of the tube guide.

19. The HVAC system of claim 16, wherein the plurality of tubes comprises a first tube having a first size and a second tube having a second size, wherein the first size and the second size are different from one another.

* * * * *